US005089059A

United States Patent [19]

Reiniche et al.

[11] Patent Number: 5,089,059

[45] Date of Patent: Feb. 18, 1992

[54] METHOD AND DEVICE FOR THE HEAT TREATMENT OF METAL STRAPS

[75] Inventors: Andre Reiniche, Clermont-Ferrand; Philippe Sauvage; Paul Van Den Berghe, both of Chateaugay, all of France

[73] Assignee: Compagnie Generale des Etablissements Michelin-Michelin & Cie, Clermont-Ferrand Cedex, France

[21] Appl. No.: 557,573

[22] Filed: Jul. 24, 1990

[30] Foreign Application Priority Data

Jul. 26, 1989 [FR] France ..... 89 10323

[51] Int. Cl.[5] ..... C21D 9/52

[52] U.S. Cl. ..... 148/16; 148/16.7; 148/19; 148/120; 266/110; 266/251

[58] Field of Search ..... 148/16, 128, 19, 16.7; 266/110, 251, 252, 254

[56] References Cited

U.S. PATENT DOCUMENTS

| | | | |
|---|---|---|---|
| 1,944,743 | 1/1934 | Kelley | 148/12 F |
| 3,950,192 | 4/1976 | Golland et al. | 1148/16.5 |
| 4,038,109 | 7/1977 | Pflieger et al. | 148/16.7 |
| 4,983,227 | 1/1991 | Reiniche et al. | 266/103 |

FOREIGN PATENT DOCUMENTS

| | | |
|---|---|---|
| 1075136 | 6/1958 | Fed. Rep. of Germany . |
| 1811121 | 11/1970 | Fed. Rep. of Germany . |
| 2111631 | 3/1972 | Fed. Rep. of Germany . |
| 2311854 | 12/1976 | France . |
| 0326005 | 8/1989 | France . |

*Primary Examiner*—Deborah Yee

*Attorney, Agent, or Firm*—Brumbaugh, Graves, Donohue & Raymond

[57] ABSTRACT

A method and device (100) for heat treating a metal strap (1), characterized by passing the strap (1) within an enclosure (2) containing a gas (3) which is practically free of forced ventilation, in such a manner that a transfer of heat takes place between the strap (1) and the walls (2a) of the enclosure (2) by means of the gas (3) contained in the enclosure (2). Metal straps (1) obtained by this method and this device (100).

13 Claims, 5 Drawing Sheets

METHOD AND DEVICE FOR THE HEAT TREATMENT OF METAL STRAPS

BACKGROUND OF THE INVENTION

The present invention relates to methods and devices for the heat treatment of metal straps. French Patent Applications 88/00904 and 88/08425 describe methods and devices which make it possible to effect pearlitization and austenitization treatments of metal wires using tubes which contain gases which are practically without forced ventilation.

These methods and devices have the following advantages:

simplicity and low investment and operating expenses since the use of molten metals or salts is avoided, as well as the use of compressors or turbines which would be necessary with forced gas circulation;

a precise law of cooling can be obtained and the phenomenon of recalescence avoided in the case of pearlitization;

the diameter of the wires can be varied within wide limits using the same installation;

in the case of pearlitization, all problems of hygiene are avoided and cleaning of the wire is unnecessary since the use of molten metals or salts is avoided.

The object of the invention is to extend these advantages to the case of the heat treatment of metal straps.

Accordingly, the invention concerns a method for the heat treatment of at least one metal strap, characterized by the fact that the strap is passed through an enclosure containing gas which is practically without forced ventilation in such a manner that a transfer of heat takes place between the strap and the walls of the enclosure by means of the gas contained in the enclosure, and by the fact that the coefficient $K_T$ defined by the equation:

$$K_T = \frac{J}{C} \times E^2$$

is selected as a function of the heat treatment to be carried out, J being the thickness of the layer of gas between the strap and the enclosure, expressed in millimeters, E being the thickness of the strap, expressed in millimeters, and C being the thermal conductivity of the gas determined at 600° C. expressed in watts.m$^{-1}$.°K$^{-1}$.

The invention also concerns a device for heat treating at least one metal strap, the device being characterized by the following features:

(a) it comprises at least one enclosure containing a gas which is practically without forced ventilation and means which make it possible to pass at least one strap through the enclosure;

(b) the device is so arranged that a transfer of heat takes place between the strap and the walls of the enclosure by means of the gas contained in the enclosure, the coefficient $K_T$ which is defined by the equation:

$$K_T = \frac{J}{C} \times E^2$$

being selected as a function of the heat treatment to be carried out, J being the thickness of the layer of gas between the strap and the enclosure, expressed in millimeters, E being the thickness of the strap, expressed in millimeters, and C being the thermal conductivity of the gas determined at 600° C. and expressed in watts.m$^{-1}$.°K$^{-1}$.

The invention also concerns metal straps obtained by the method and device in accordance with the invention.

Such straps can be used, for instance, to reinforce articles, in particular pneumatic tires.

The invention will be easily understood by means of the non-limitative examples which follow and the diagrammatic figures relating to these examples.

DESCRIPTION OF THE EMBODIMENTS

The expression "strap" is to be taken in a broad sense and covers any elongated element having a cross section perpendicular to its longitudinal direction which has a width substantially greater than its thickness, which element may have the shape of a substantially flat plate or the shape of a structural section. The ratio between the width of the strap and its thickness is preferably at least equal to 10, the width of the strap being determined along the surface of the strap on its cross section perpendicular to its longitudinal direction.

Figure 1:
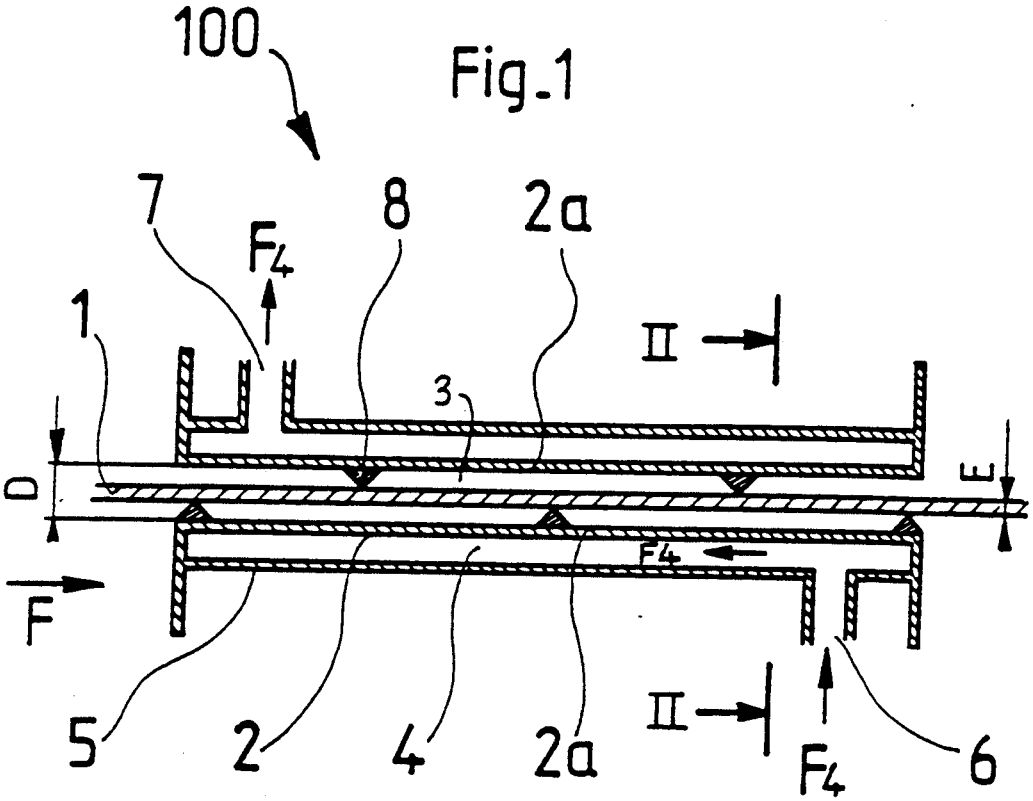
FIG. 1 is a longitudinal section through a device in accordance with the invention, the section being taken along the line segments I—I of FIG. 2.
Figure 2:
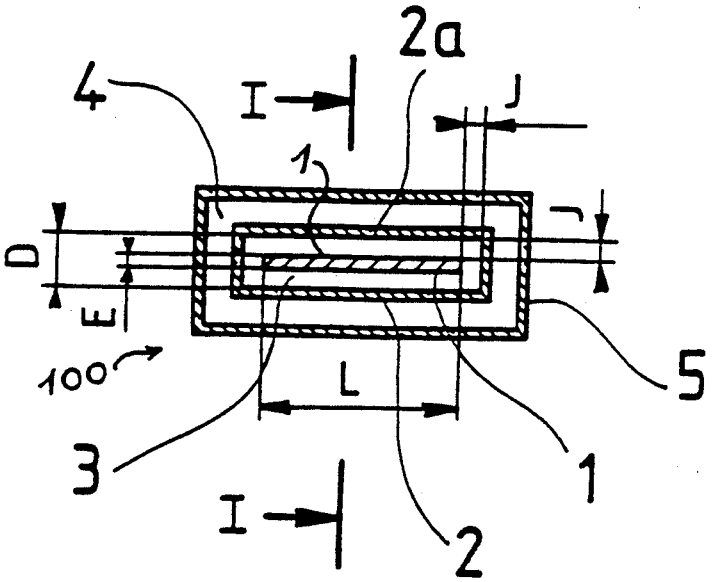
FIG. 2 shows the device of FIG. 1 in cross section, the section of FIG. 2 being indicated diagrammatically by the straight line segments II—II in FIG. 1.

FIGS. 1 and 2 show a device 100 in accordance with the invention which makes it possible to heat treat a metal strap 1. The device 100 for the heat treatment of the strap 1 comprises an enclosure 2 containing a gas 3 which is practically without forced ventilation.

The device 100 has means which make it possible to pass the strap 1 through the enclosure 2, these means, not shown for purposes of simplification, being known means, for instance rollers on which the strap 1 is wound, at least one of these rollers being driven by a motor.

The expression "practically without forced ventilation" means that the gas 3 within the enclosure 2 is either stationary or subject only to slight ventilation which does not substantially change the heat exchange between the strap 1 and the gas 3, this slight ventilation being due, for instance, merely to the displacement of the strap 1 itself. The displacement of the strap 1 within the enclosure 2 is diagrammatically indicated by the arrow F in FIG. 1.

The device 100 comprises a heat exchange fluid 4 flowing on the outside of the enclosure 2 within the hollow envelope 5 surrounding the enclosure 2. The heat exchange fluid 4 arrives in the envelope 5 via the connection 6 and emerges through the connection 7, the flow of the heat exchange fluid 4 being diagrammatically indicated by the arrows F4 in FIG. 1. The known means used to cause the fluid 4 to circulate have not been shown for purposes of simplification, said means comprising, for instance, a pump. The fluid 4 is, for instance, water. Upon the heat treatment, a transfer of heat takes place between the strap 1 and the walls 2a of the enclosure 2 which face the strap 1, via the gas 3. The heat transfer takes place also between the walls 2a and the fluid 4. The enclosure 2 and the envelope 5 are made of heatconducting materials, for instance metallic materials, the transfer taking place from the strap 1 towards the fluid 4 in the case of a cooling treatment of the strap 1.

The guides 8, which are, for instance, of ceramic material, assure the guiding of the strap 1.

The coefficient $K_T$ is given by the equation $$K_T = \frac{J}{C} \times E^2$$

J being the thickness, expressed in millimeters, of the layer of gas 3 between the strap 1 and the enclosure 2, E being the thickness of the strap expressed in millimeters, C being the thermal conductivity of the gas 3 determined at 600° C, expressed in watts.$^{-1}$.°K$^{-1}$. J is preferably equal to at least 0.2 mm and at most 2 mm. This coefficient $K_T$ is selected as a function of the heat treatment to be carried out, as described below. There is preferably the relationship $0.01 \leqq K_T \leqq 100$. D is the distance between the walls 2a, measured in the direction of the width E, and $D=2J+E$. The width of the strap 1 is represented by L.

The gas 3 may be of very different nature, for instance hydrogen, nitrogen, helium, a mixture of hydrogen and nitrogen, of hydrogen and methane, of nitrogen and methane, of helium and methane or of hydrogen, nitrogen and methane.

Figure 3:
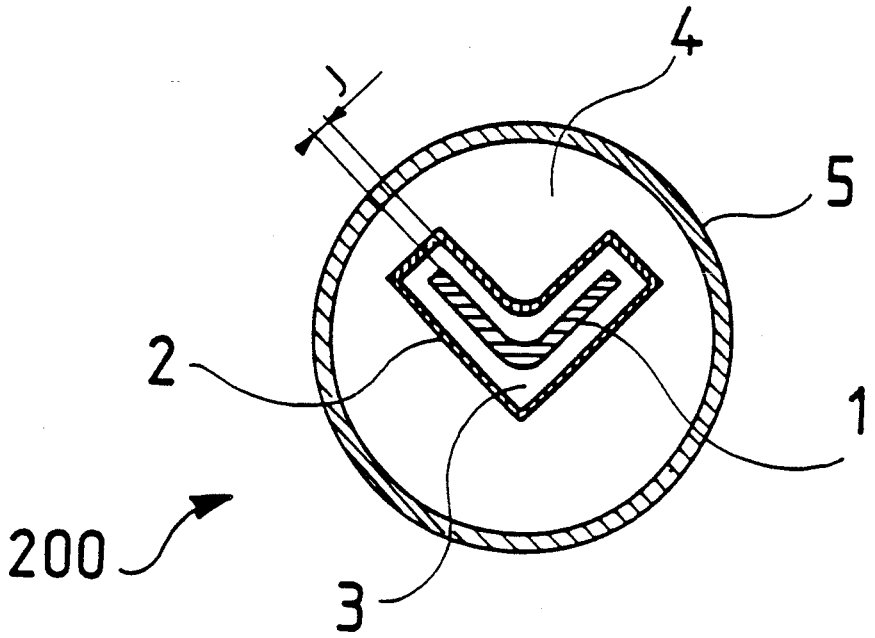
FIG. 3 shows, in cross section transverse to the direction of travel of the strap, another device in accordance with the invention.
Figure 4:
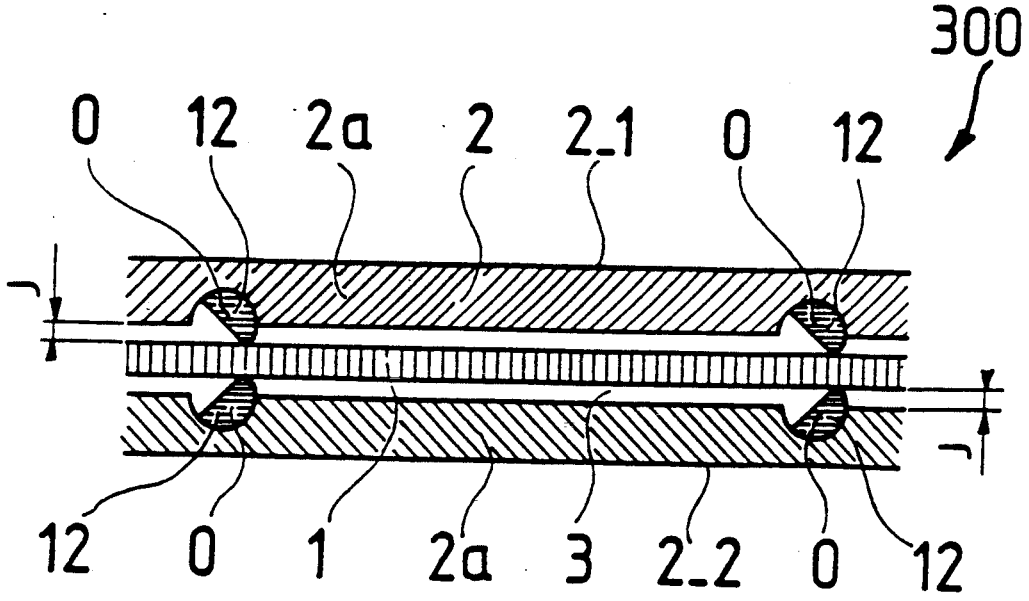
FIG. 4 shows a longitudinal section, taken longitudinally to direction of travel of the strap, of another device in accordance with the invention.

The strap 1 shown in FIGS. 1 and 2 has the shape of a flat plate, but the invention applies to cases in which the strap is of a shape other than flat. Thus the device 200 in accordance with the invention which is shown in FIG. 3 makes it possible to treat a strap having an angular shape, the enclosure 2 being then adapted so that there is a practically constant thickness J of gas 3 between the strap 1 and the enclosure 2 which is, for instance, itself arranged in the outer envelope 5 of cylindrical shape. The thickness J can be adapted to the heat treatment to be carried out or to the strap. For example, in the device 300 in accordance with the invention which is shown in FIG. 4, the adjustment of the thickness J is effected by means of rods 12 of semicylindrical section which turn around an axis 0, which modifies the distance between the walls 2a of the enclosure 2. Other means can be used, for instance screws.

Figure 5:
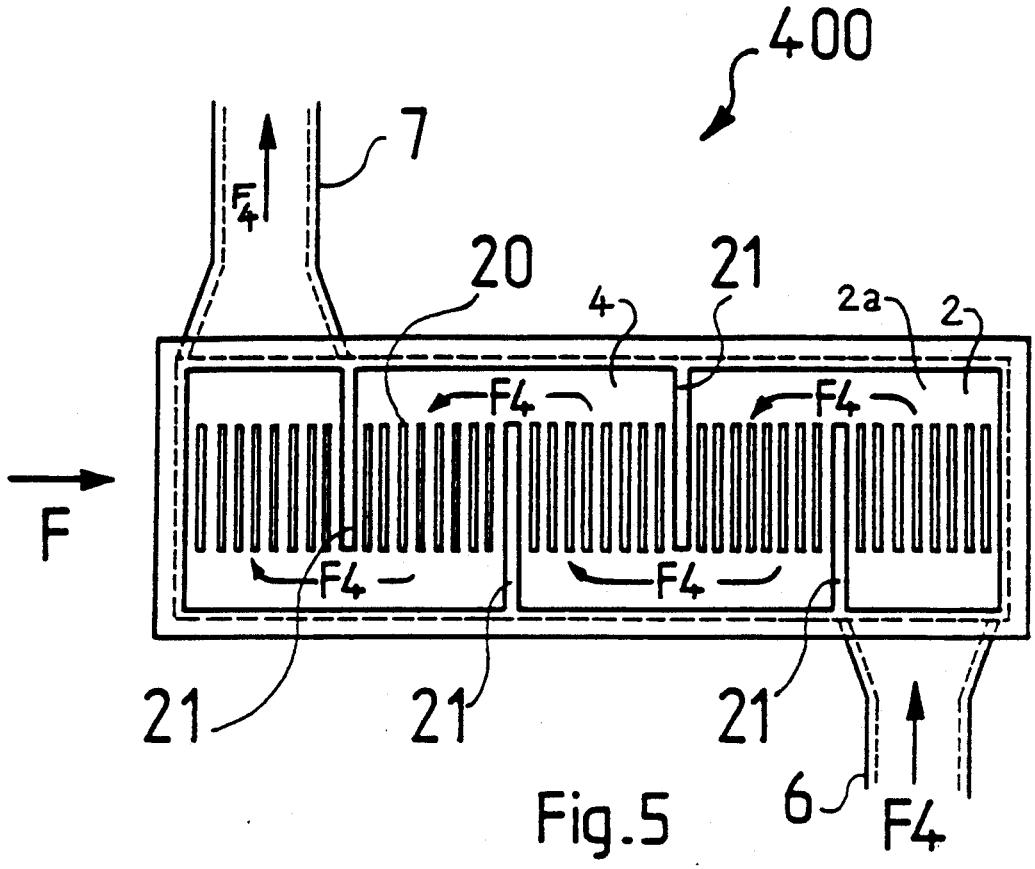
FIG. 5 shows, in top view, a part of another embodiment of the device having fins.

FIG. 5 shows another device 400 in accordance with the invention, the envelope 5 being removed. Each wall 2a has fins 20 arranged on the side of the fluid 4 in order to improve the heat exchange between the wall 2a and the fluid 4. These fins 20 are oriented perpendicular to the longitudinal direction of the strap 1, which direction is diagrammatically indicated by the arrow F. Deflectors 21 permit the fluid 4 to flow in a baffled path between the inlet connection 6 and the outlet connection 7. This arrangement makes it possible to promote the heat exchange between the strap 1 and the fluid 4.

Figure 6:
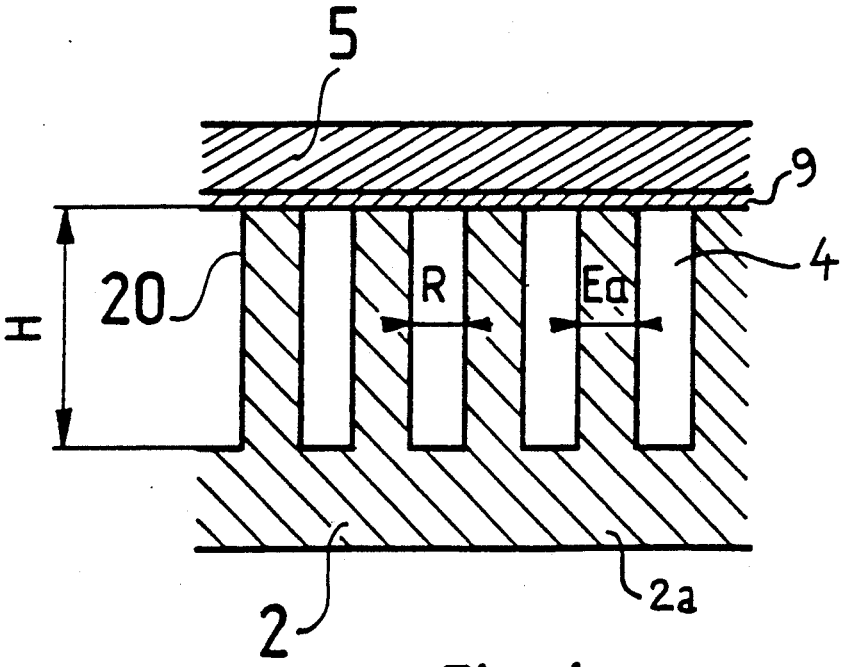
FIG. 6 shows in longitudinal section a part of the fins of the device shown in FIG. 5.

FIG. 6 shows four fins 20 in section along a plane perpendicular to the strap 1, along the longitudinal direction of this strap. It can be seen from FIG. 6 that the fins 20 have a height H between the enclosure 2 and the sealing joint 9, these fins being separated by the distance R, the thickness of the fins being represented by Ea.

Figure 7:
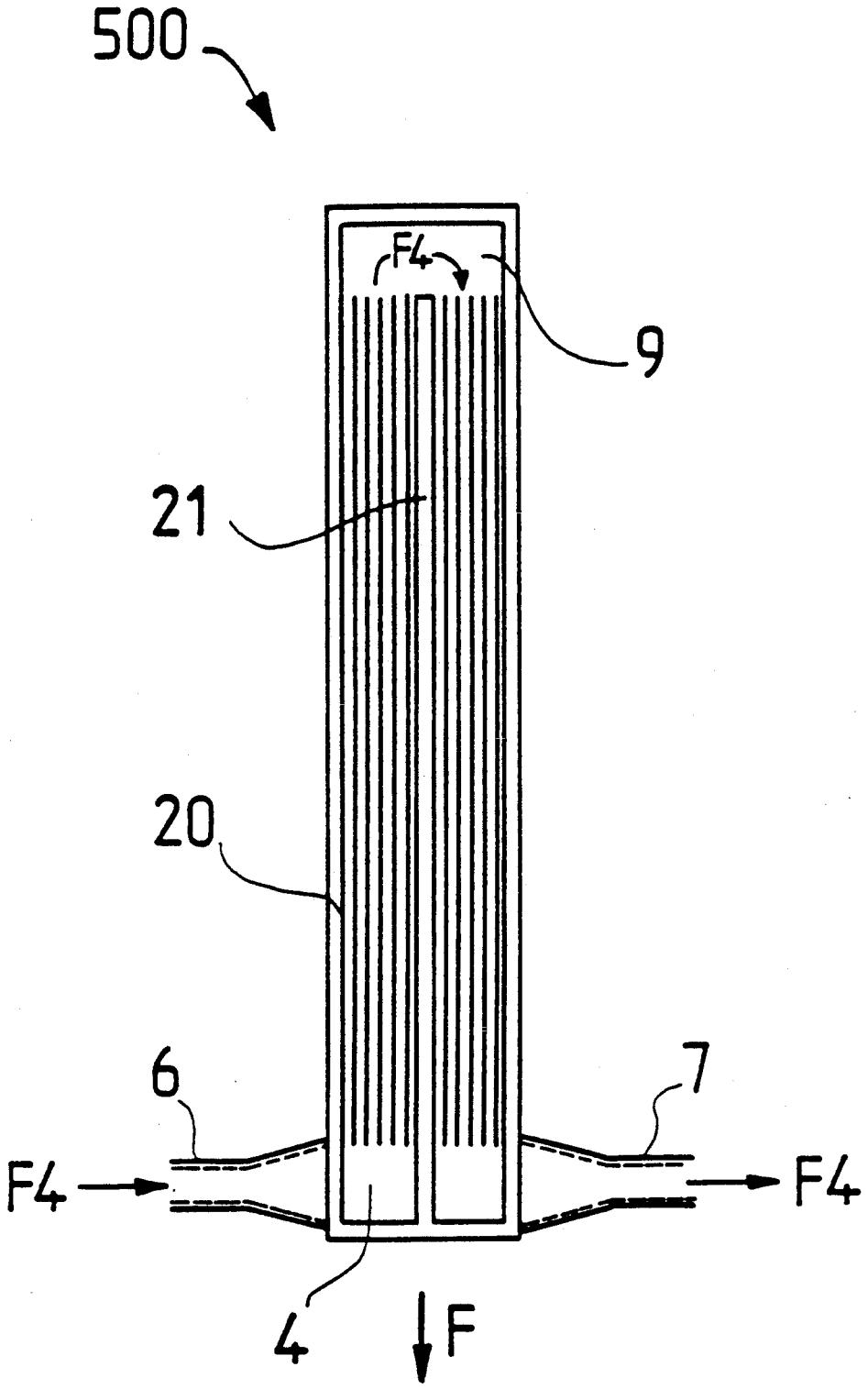
FIG. 7 shows, in top view, a part of another device in accordance with the invention.

FIG. 7 shows, in top view, the flow of the heat exchange fluid 4 of another device 500 in accordance with the invention. This device 500 is similar to the device 400 with the difference that the fins 20 are oriented along the length of the strap, that is to say parallel to the arrow F, the feeding 6 and the departure 7 of the fluid 4 taking place at the same end of the device with respect to the direction of travel F.

In this device, the fluid 4 flows parallel to the length of the strap but along sections of opposite direction due to one or more deflectors 21 arranged also in the direction of the length of the strap, only one of these deflectors 21 being shown in FIG. 7 for purposes of simplification of the drawing.

Figure 8:
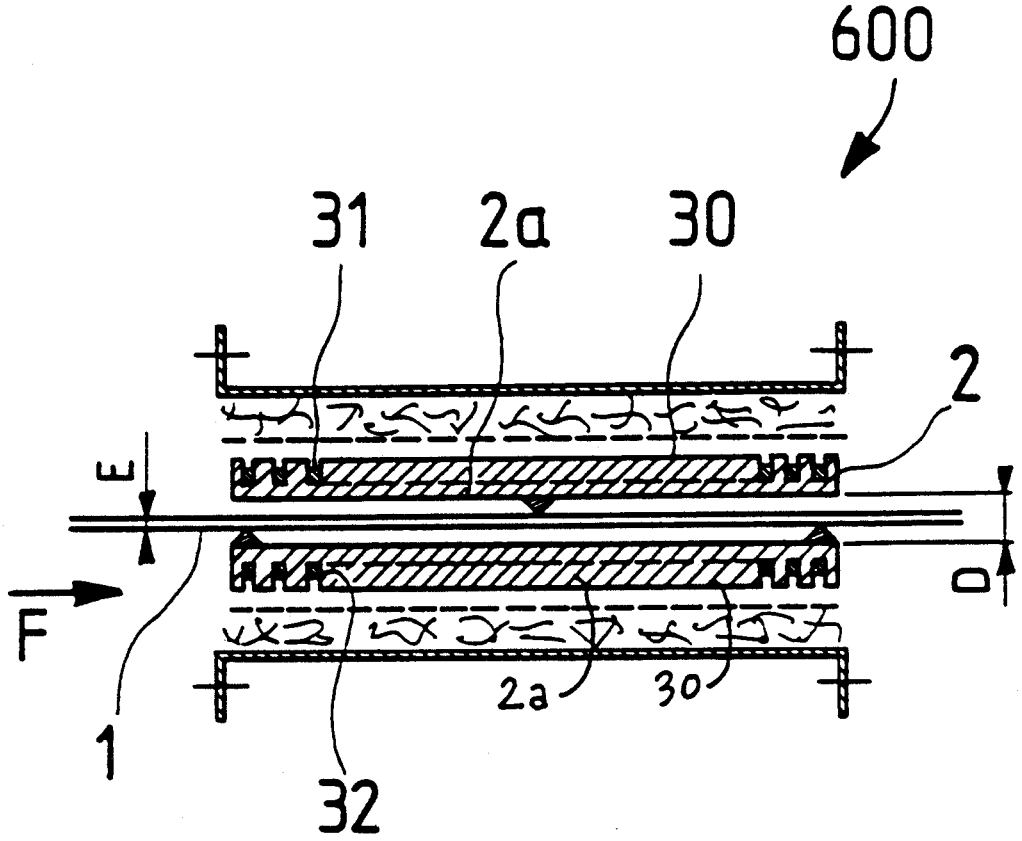
FIG. 8 shows in longitudinal section another device in accordance with the invention, this section being diagrammatically indicated by the straight line segments VIII—VIII of FIG. 9.
Figure 9:
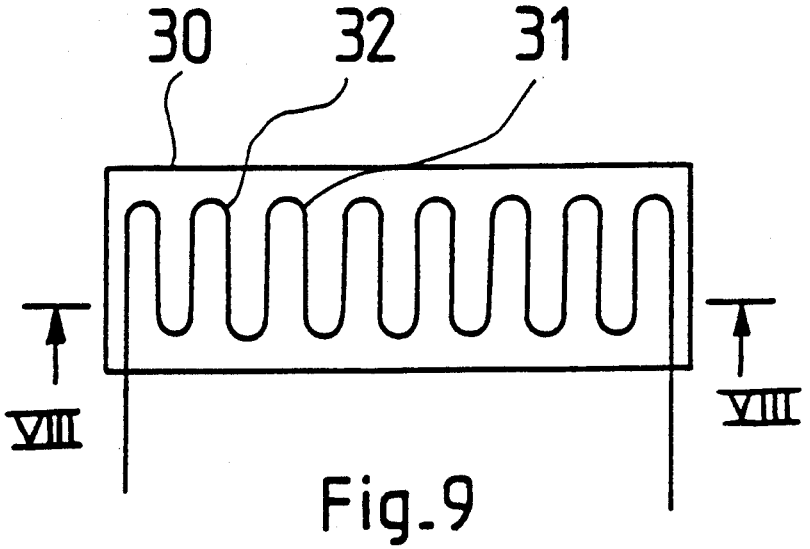
FIG. 9 shows, in top view, a part of the device shown in FIG. 8.

The invention also concerns devices without heat exchange fluid, such as, for instance, the device 600 shown in FIG. 8. The walls 2a of the enclosure 2 of this device 600 are formed of two ceramic plates 30 separated by the distance D. These plates 30 have grooves 31 in which electric heating resistors 32 are disposed in contact with the plates 30. By way of example, each plate 30 has a groove in which a resistor 32 is arranged, this resistor having a serpentine shape, as shown in FIG. 9 which is a top view of a plate 30 with its resistor 32. This device 600 is used to heat the strap 1 or prevent its cooling.

The examples which follow are intended to describe heat treatments of straps carried out in accordance with the invention. All the straps treated are, for example, in the form of flat plates, that is to say, they have a rectangular cross-section perpendicular to the longitudinal direction.

EXAMPLE 1

Treatment of a steel in two phases (dual phase). This treatment consists in heating the strap in order to obtain a homogenous austenite and cooling it to obtain a ferrite+bainite structure.

characteristics of the strap: thickness E=3.5 mm; width L=550 mm;

composition of the steel of this strap: C: 0.10%; Mn: 0.65%; Si: 0.5%; S=0.007%; P: 0.015%; Al: 0.03%; Cu: 0.25%; Nb: 0.02%;

speed of passage: 0.5 m/s.

The strap treatment installation comprises three sections, namely a heating section and two cooling sections, the characteristics of which are as follows:

HEATING SECTION

Two elements in series similar to the device 600 previously described are used. Total nominal power of the first element is 3000 kW and of the second element 1600 kW. Adjustment of the temperature by infrared pyrometer. Nature of the gas 3: pure hydrogen; temperature of the plates 30: 1200° C.; thickness J: 0.25 mm; temperature of the strap: at the inlet, 20° C., at the outlet, 850°±3° C. Time of stay of the strap in the heating section: 4.8 seconds. For this section, $K_T=7.29$.

FIRST COOLING SECTION

Two elements in series similar to the device 500 but without fins are used, having 5 deflectors 21 on each side of the enclosure 2. Rate of flow of water: 11 liters per second. Nature of the gas 3: mixture of hydrogen and nitrogen with 60% by volume hydrogen, J=1.7 mm. Temperature of the strap at the inlet 850° C.; at the outlet 750° C., with a time of stay of the strap of 10 seconds. For this cooling section, $K_T=94.66$.

SECOND COOLING SECTION

This section comprises an element similar to the device 400 with fins and 5 deflectors 21 on each side of the enclosure 2. Rate of flow of water: 40 liters per second. Nature of the gas 3: pure hydrogen. J=0.2 mm. Temperature of the strap: at the inlet 750° C., at the outlet 350° C., for a time of stay of the strap of 4 seconds. $K_T=5.83$.

Results obtained by this total treatment:

Structure of the steel: ferrite (85%)+bainite

Elastic limit: 480.7 MPa.

Tensile stress upon rupture: 612.5 MPa

Elongation upon rupture: 29%

The elastic limit is the stress for which there is a residual elongation of 0.2%.

Preferably, for such a dual-phase steel treatment, the entire heat treatment is carried out in such a manner as to have the relationship:

$$4 \leqq K_T \leqq 100.$$

EXAMPLE 2

This example concerns the treatment of a carbon steel of tempered martensitic structure in accordance with Patent FR 2 311 854.

There is used a strap of a thickness of E=100 μm and width of L=300 mm obtained by cold rolling a strap of a thickness of 2 mm, the steel of which has the following composition: C: 0.085%; Mn: 0.3%; Si: 0.05%; S: 0.024%; P: 0.024%; Cu: 0.056%; Cr: 0.05%; Ni: 0.025%; N: 0.003%; 0 total: 0.0145%.

Speed of passage of the strap: 1 meter per second.

The installation has 8 sections, corresponding to the 8 phases of the process.

PHASE 1: CEMENTATION

Two elements in series in accordance with the device 600 are used, each having a length of 2 m, nominal heating power: first element: 150 kW; second element: 50 kW. J=0.8 mm; $K_T=0.019$.

The cementation gas has the following composition: $H_2$: 85%; $CH_4$: 12%; $N_2$: 3% (percent by volume).

Temperature of the strap: at the inlet 20° C.; at the outlet: 1000° C.

The carbon content at the outlet from the cementation furnace is 0.8%. Upon this cementation of mild steel there is preferably obtained a steel having between 0.4 and 0.9% carbon. The product C%×0% is $11.6\times10^{-3}$. The tensile rupture strength is 110 kg/mm$^2$.

PHASE 2: AUSTENITIZATION

This phase comprises two steps: increasing of temperature and maintaining of temperature.

Increase in temperature:

In this step the strap is heated so as to obtain a homogenous austenite (good dissolving of the carbides). Two elements in accordance with device 600 are used in series. Nominal power: for the first element: 100 kW; for the second element: 60 kW. J=0.8 mm. Nature of the gas 3: pure hydrogen. Temperature of the strap: at the inlet 20° C.; at the outlet 950°±3° C. Time of stay of the strap: 1.5 seconds. Upon this step $K_T=0.019$.

Maintaining of temperature:

Use of an element in accordance with device 600, nominal heating power: 50 kW; nature of the gas 3: pure hydrogen; J=2 mm.

The strap is maintained at 950°±3° C. Time of stay of the strap: 1 second. Upon this step, $K_T=0.048$.

PHASE 3: FIRST RAPID COOLING

Use of two elements in series similar to device 400 with fins, each element having 5 deflectors on each side of the enclosure 2. Total rate of flow of water for this phase: 1.5 liters per second. Nature of the gas 3: mixture of $H_2+N_2$ with 75% by volume $H_2$. J=0.7 mm.

Temperature of the strap: at the inlet: 950° C.; at the outlet: 500° C.

Time of stay of the strap: 0.5 seconds.

Upon this phase $K_T=0.025$.

PHASE 4: FIRST SLOW COOLING

Use of two elements in series similar to device 500 but without fins, each element having 5 deflectors 21 on each side of the enclosure 2. Total rate of flow of water: 1.3 liters per second. Nature of the gas 3: mixture of $H_2+N_2$ with 75% by volume $H_2$J=1 mm.

Temperature of the strap: at the inlet: 500° C.; at the outlet: 50° C. Time of stay of the strap: 3 seconds. For this phase, $K_T=0.036$.

PHASE 5: AUSTENITIZATION AT LOW TEMPERATURE

In this phase a low temperature austenitization is carried out with a short holding time above AC3, which avoids enlargement of the austenite grain and permits an improvement in the mechanical properties of the product.

Two heating elements similar to the device 600 are used. Nominal heating powers: first element: 85 kW; second element 45 kW. Regulation of the temperature by infrared pyrometer.

Nature of the gas 3: pure hydrogen; J=2.2 mm.

Temperature of the strap: at the inlet: 20° C.; at the outlet: 800°±3° C.

Time of stay of the strap: 1.5 seconds.

For this phase, $K_T=0.052$.

PHASE 6: SECOND RAPID COOLING

Two elements in accordance with device 500 without fins are used, each element having 5 deflectors 21 on each side of the enclosure 2. Total flow of water: 1 liter per second. Nature of the gas 3: mixture of $H_2+N_2$ with 60% by volume of $H_2$; J=1.5 mm.

Temperature of the strap: at the inlet: 800° C.; at the outlet 500° C.

Time of stay of the strap: 0.5 seconds.

For this phase, $K_T=0.068$.

PHASE 7: SECOND SLOW COOLING

Conditions identical to Phase 4.

PHASE 8: RAPID TEMPERING

This phase comprises a step of increasing temperature and a step of maintaining of the temperature.

Step of increase in temperature:

An element in accordance with device 600 is used. Nominal heating power: 50 kW. Nature of the gas 3: pure $H_2$; J=1.3 mm. Temperature of the strap: at the inlet: 20° C.; at the outlet: 350°±3° C. Time of stay of the strap: 0.5 seconds. For this step, one has $K_T=0.031$.

Step of maintaining of temperature:

An element in accordance with device 600 is used. Nominal power: 30 kW. Regulation of the temperature of the strap at the outlet by infrared pyrometer. Nature of the gas 3: pure $H_2$; J=2 mm. Temperature of the strap: at the inlet and the outlet: 350°±3° C. Time of stay of the strap: 2.5 seconds. For this step: $K_T=0.048$.

The strap obtained at the end of this eight-phase treatment has the following characteristics: carbon content: 0.8%; product $C\% \times 0\% = 16.6 \times 10^{-3}$; tensile strength upon rupture: 2630 MPa. Elongation: 5.3%.

In case of the treatment of a carbon steel, in order to obtain a martensitic structure a relationship of $0.01 \leqq K_T \leqq 0.1$ is preferred.

EXAMPLE 3

This example concerns the heating of a steel strap before galvanization by steeping in a bath of molten zinc. This preheating is effected with a device 600, the nominal heating power of which is 1300 kW. Dimensions of the strap: thickness E: 2 mm; width L: 1000 mm; J=0.4 mm.

Speed of travel of the strap: 0.2 m/second. Temperature of the strap: at the inlet: 25° C.; at the outlet 620°±3° C.; gas used: pure $H_2$.

Time of stay of the strap: 3.25 seconds.

In this example, $K_T=3.81$.

For preheating before galvanization, one preferably has the relationship: $1 \leqq K_T \leqq 10$.

EXAMPLE 4

This example describes a pearlitization treatment of a steel strap with one heating phase and two cooling phases.

The composition of the steel used is as follows:

C: 0.80%; Mn: 0.69%; Si: 0.21%; S: 0.025%; P: 0.018%; Al: 0.081%; Ca: 0.044%; Cr: 0.059%; Ni: 0.015%.

Dimensions of the strap: thickness E: 2 mm, width L: 300 mm. Speed of travel: 0.5 meters per second.

HEATING PHASE

In this phase the austenitization is effected. A device 600 is used, the nominal heating power of which is 1700 kW. Nature of the gas 3: pure $H_2$; J=0.25 mm.

Temperature of the strap: at the inlet 20° C.; at the outlet 980°±3° C. Time of stay of the strap: 5 seconds. For this phase, $K_T$32 2.38.

FIRST COOLING PHASE

Two elements in series similar to device 400 with fins are used and, for each element, 5 deflectors 21 on each side of the enclosure 2. Total rate of flow of water: 30 liters per second; nature of the gas 3: pure $H_2$; J=0.3 mm.

Temperature of the strap: at the inlet 980° C.; at the outlet 250° C. Time of stay of the strap: 8 seconds.

For this phase $K_T=2.86$.

SECOND COOLING PHASE

A vat of water is used in which the strap is immersed in known manner, making it possible to bring the strap to room temperature.

The strap which has undergone this entire treatment structure of the steel: 100% pearlite;

tensile stress upon rupture: 1150 MPa;

elongation upon rupture: 7%.

In such a pearlitization treatment, one preferably has $1 \leqq K_T \leqq 8$.

In all the examples described above, the invention permits the following advantages:

simplicity of procedure;

flexibility of adjustments, which makes it possible to treat straps of variable thickness in the same installation;

low investment and operating costs since, as a result of the absence of forced circulation, the use of compressors or turbines is avoided and the use of molten metals or salts is also avoided;

all problems of hygiene are avoided since molten metals or salts are not employed and cleaning of the strap treatment is not necessary.

The invention is not limited to the embodiments described above. In particular, the invention covers the case in which several straps are treated simultaneously.

We claim:

1. A method for the heat treatment of at least one metal strap, wherein the strap is passed through an enclosure containing a gas which is practically without forced ventilation, in such a manner that a transfer of heat takes place between the strap and the walls of the enclosure by means of the gas contained in the enclosure, wherein the coefficient $K_T$ defined by the equation:

$$K_T = \frac{J}{C} \times E^2$$

is selected as a function of the heat treatment to be carried out, J being the thickness of the layer of gas between the strap and the enclosure, expressed in millimeters; E being the thickness of the strap, expressed in millimeters, and C being the thermal conductivity of the gas determined at 600° C., expressed in watts.$m^{-1}$.°$K^{-1}$ and wherein there is the relationship $0.01 \leqq K_T \leqq 100$.

2. A method according to claim 1, wherein the relationship is 0.2 mm$\leqq$J$\leqq$2 mm.

3. A method according to claim 1, wherein a treatment of steel strap is carried out.

4. A method according to claim 3, wherein a steel strap in two phases, ferrite and bainite, is prepared with the relationship $4 \leqq K_T \leqq 100$.

5. A method according to claim 3, characterized by the fact that a strap of martensitic structure is treated, with the relationship $0.01 \leqq K_T \leqq 0.1$.

6. A method according to claim 5, characterized by the fact that a cementation treatment is carried out in order to obtain between 0.4 and 0.9% carbon.

7. A method according to claim 3, characterized by the fact that preheating is effected before carrying out a galvanization treatment of the strap, with the relationship $1 \leqq K_T \leqq 10$.

8. A method according to claim 3, wherein a pearlitization treatment is carried out with $1 \leqq K_T \leqq 8$.

9. A device for the heat treatment of at least one metal strap, wherein:

(a) the device comprises at least one enclosure containing a gas which is practically without forced ventilation and means permitting the passing of at least one strap through said enclosure;

(b) the device is arranged so that a transfer of heat takes place between the strap and the walls of the enclosure by means of the gas contained in the enclosure, the coefficient $K_T$ defined by the equation $$K_T = \frac{J}{C} \times E^2$$

being selected as a function of the heat treatment to be carried out, J being the thickness of the layer of gas between the strap and the enclosure, expressed in millimeters, E being the thickness of the strap, expressed in millimeters, and C being the thermal conductivity of the gas determined at 600° C., expressed in watts.$m^{-1}$.°$K^{-1}$, and wherein $0.01 \leqq K_T \leqq 100$.

10. A device according to claim 9, wherein by the fact that 0.2 mm$\leqq$J$\leqq$2 mm.

11. A device according to claim 9, wherein that it has means making it possible to vary J.

12. A device according to claim 9, wherein it has at least one electric resistor in contact with a wall of the enclosure.

13. A device according to claim 9, wherein it has means which make it possible to cause a heat exchange fluid to flow on the outside of the enclosure.

* * * * *

UNITED STATES PATENT AND TRADEMARK OFFICE

CERTIFICATE OF CORRECTION

PATENT NO. : 5,089,059

DATED : Feb. 18, 1992

INVENTOR(S) : Reiniche, et al

It is certified that error appears in the above-indentified patent and that said Letters Patent is hereby corrected as shown below:

Col. 3, line 32, "$^{-1}.^{\circ}K^{-1}$" should read --$m^{-1}.^{\circ}K^{-1}$--. Col. 6, line 34, "$H_2J$" should read --$H_2$. J--Col. 8, line 6, "treatment" should read --treatment has the following characteristics:--; Col. 10, lines 5-6, "wherein by the fact that" should read --wherein--; line 7, "wherein that" should read --wherein--.

Signed and Sealed this

Twenty-ninth Day of June, 1993

*Attest:*

*Attesting Officer*

Michael K. Kirk

MICHAEL K. KIRK

*Acting Commissioner of Patents and Trademarks*